US007696691B2

(12) United States Patent
Yoo et al.

(10) Patent No.: US 7,696,691 B2
(45) Date of Patent: Apr. 13, 2010

(54) PLASMA DISPLAY APPARATUS INCLUDING A PLURALITY OF CAVITIES DEFINED WITHIN A BARRIER STRUCTURE

(75) Inventors: Hun-Suk Yoo, Suwon-si (KR); Won-Ju Yi, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 536 days.

(21) Appl. No.: 11/339,939

(22) Filed: Jan. 25, 2006

(65) Prior Publication Data

US 2006/0170353 A1 Aug. 3, 2006

(30) Foreign Application Priority Data

Feb. 2, 2005 (KR) ..... 10-2005-0009724

(51) Int. Cl.
*H01J 17/49* (2006.01)

(52) U.S. Cl. ..... 313/582; 313/584; 313/272

(58) Field of Classification Search ..... 313/582–587, 313/272; 345/60–67
See application file for complete search history.

(56) References Cited

U.S. PATENT DOCUMENTS

| | | | | |
|---|---|---|---|---|
| 5,371,437 | A | 12/1994 | Amano | |
| 2005/0093444 | A1 * | 5/2005 | Woo et al. | 313/582 |
| 2006/0170352 | A1 * | 8/2006 | Jung et al. | 313/582 |

FOREIGN PATENT DOCUMENTS

| | | |
|---|---|---|
| JP | 07-029499 | 1/1995 |
| JP | 08-045433 | 2/1996 |
| JP | 10-214569 | 8/1998 |
| JP | 2000-260335 | 9/2000 |
| JP | 2001-345054 | 12/2001 |
| JP | 2002-304948 | 10/2002 |
| JP | 2003-208850 | 7/2003 |
| JP | 2003-242895 | 8/2003 |
| JP | 2004-311274 | 11/2004 |
| JP | 2005-135893 | 5/2005 |
| JP | 2005-166654 | 6/2005 |
| KR | 10-0337364 | 5/2002 |

OTHER PUBLICATIONS

First Office Action for Chinese Patent Application No. 200610006847.6 dated May 8, 2009 by State Intellectual Property Office, P.R. China.

* cited by examiner

*Primary Examiner*—Karabi Guharay
(74) *Attorney, Agent, or Firm*—Knobbe Martens Olson & Bear LLP

(57) ABSTRACT

A plasma display panel (PDP) including a plurality of cavities within a barrier structure is disclosed. In one embodiment, the PDP includes i) an upper substrate, ii) a lower substrate facing the upper substrate, iii) the barrier structure disposed between the upper substrate and the lower substrate and defining discharge cells, iv) upper discharge electrodes arranged at intervals within the barrier structure and each surrounding at least parts of the discharge cells, v) lower discharge electrodes arranged at intervals within the barrier structure, located under the upper discharge electrode, and each surrounding at least parts of the discharge cells, and vi) phosphor layers disposed over the discharge cells. According to one embodiment of the present invention, ineffective power consumption can be reduced and heat generated in the discharge cells can be effectively dissipated.

27 Claims, 9 Drawing Sheets

PLASMA DISPLAY APPARATUS INCLUDING A PLURALITY OF CAVITIES DEFINED WITHIN A BARRIER STRUCTURE

CROSS-REFERENCE TO RELATED PATENT APPLICATION

This application claims the benefit of Korean Patent Application No. 10-2005-0009724, filed on Feb. 2, 2005, in the Korean Intellectual Property Office, the disclosure of which is incorporated herein in its entirety by reference.

BACKGROUND OF THE INVENTION

1. Field of the Invention

The present invention relates to a plasma display panel that can reduce ineffective power consumption and improve heat dissipation.

2. Description of the Related Technology

Plasma display panel (PDP) apparatuses can provide large screens and certain advantages, such as a high-quality image display, a very thin and light design, and a wide-range viewing angle. PDPs have attracted considerable attention as the most promising next-generation flat display devices, because they can be manufactured in a simplified manner and can be easily manufactured in a large size compared with other flat display panels.

Such PDPs are classified into a direct current (DC) type, an alternating current (AC) type, and a hybrid type according to discharge voltages applied to discharge cells. PDPs may also be classified into a facing discharge type and a surface discharge type according to the type of a discharge structure. In recent years, AC type PDPs having a surface discharge type three-electrode structure are generally used.

FIG. 1 illustrates a conventional AC surface-discharge type PDP 10 having a three-electrode structure. The PDP 10 includes an upper substrate 11 and a lower substrate 21 opposite to the upper substrate 11.

Common electrodes 12 and scan electrodes 13 together define discharge gaps and are formed on a bottom surface of the upper substrate 11. The common electrodes 12 and the scan electrodes 13 are buried in an upper dielectric layer 14. A protective layer 15 is formed on the lower surface of the upper dielectric layer 14.

Address electrodes 22, intersecting the common electrodes 12 and the scan electrodes 13, are formed on the upper surface of the lower substrate 21. The address electrodes 22 are buried in a lower dielectric layer 23. Barrier ribs 24 are arranged at predetermined intervals on the upper surface of the lower dielectric layer 23, thereby partitioning discharge spaces 25. A phosphor layer 26 is formed in each of the discharge spaces 25. The discharge spaces 25 are filled with discharge gas.

In the PDP 10, ultraviolet radiation is produced from plasma generated due to discharge in the discharge spaces 25. The ultraviolet light excites the phosphor layers 26. The excited phosphor layers 26 emit visible light, and thus an image is displayed using the visible light.

However, about 40% of the visible light emitted by the phosphor layers 26 are absorbed by the electrodes 12 and 13, the upper dielectric layer 14, and the protective layer 15 sequentially formed on the lower surface of the upper substrate 11 because those elements (12-15) block the light transmitting path of the PDP 10. Thus, the conventional PDP 10 has reduced luminous efficiency. Furthermore, when an image is being displayed for a long period of time, charged particles of the discharge gas are ion sputtered to the phosphor layers 26 due to an electrical field, so that image sticking or permanent afterimage occurs. This leads to reduction of the lifespan of the PDP 10.

SUMMARY OF CERTAIN INVENTIVE ASPECTS

One aspect of the present invention provides a plasma display panel including: i) an upper substrate, ii) a lower substrate facing the upper substrate, iii) a barrier structure disposed between the upper substrate and the lower substrate and defining discharge cells, the barrier structure having cavities, iv) upper discharge electrodes arranged at intervals within the barrier structure and each surrounding at least parts of the discharge cells, v) lower discharge electrodes arranged at intervals within the barrier structure, located under the upper discharge electrode, and each surrounding at least parts of the discharge cells and vi) phosphor layers formed in the discharge cells.

In one embodiment, each of the discharge cells may have a closed structure.

In one embodiment, the upper discharge electrodes may include upper discharge portions (or body portions) each having a shape that surrounds at least a part of each discharge cell and upper connection portions connecting the upper discharge portions to each other. In one embodiment, the lower discharge electrodes may include lower discharge portions (or body portions) each having a shape that surrounds at least a part of each discharge cell and lower connection portions connecting the lower discharge portions to each other.

In one embodiment, the cavities within the barrier structure may be vertically formed between upper discharge portions and between lower discharge portions.

In another embodiment, the cavities within the barrier structure may be further horizontally formed between the upper discharge portions and the lower discharge portions.

In one embodiment, the cavities within the barrier structure may be vertically connected to or disconnected from each other.

In one embodiment, the cavities within the barrier structure may be horizontally formed between the upper discharge portions and the lower discharge portions.

In one embodiment, the cavities within the barrier structure may be each formed around the discharge cells to have a shape corresponding to the shape of the discharge cells.

In one embodiment, address electrodes spaced from each other and surrounding at least parts of the discharge cells may be further included in the barrier structure and each run in a direction orthogonal to the running direction of each of the upper and lower discharge electrodes.

In one embodiment, the address electrodes may include address discharge portions having ring shapes to surround the discharge cells and address connection portions connecting the address discharge portions to each other.

In one embodiment, the cavities within the barrier structure may be vertically formed and disposed between upper discharge portions, between lower discharge portions, and between address discharge portions.

In another embodiment, the cavities within the barrier structure may be further horizontally formed and disposed between the upper discharge portions and the lower discharge portions and between the lower discharge portions and the address discharge portions.

In one embodiment, the cavities within the barrier structure may be vertically connected to or disconnected from each other.

In one embodiment, the cavities within the barrier structure may be horizontally formed and disposed between the upper discharge portions and the lower discharge portions and between the lower discharge portions and the address discharge portions.

In one embodiment, the cavities within the barrier structure may be each formed around the discharge cells to have a shape corresponding to the shape of the discharge cells.

In one embodiment, the upper discharge electrodes, the lower discharge electrodes, and the address electrodes may each be formed of conductive metal.

In one embodiment, grooves may be formed on a surface of the upper substrate close to the barrier structure such as to face the discharge cells, and the grooves may be coated with phosphor layers.

In one embodiment, when an image is displayed on the upper substrate by visible light transmitted by the upper substrate, the phosphor layers formed on the grooves formed on the upper substrate may be formed of transmissive phosphor.

In one embodiment, when an image is displayed on the lower substrate by visible light transmitted by the lower substrate, the phosphor layers formed on the grooves formed on the upper substrate may be formed of reflective phosphor.

In one embodiment, the upper discharge electrodes may run in a direction orthogonal to the running direction of the lower discharge electrodes.

In one embodiment, the barrier structure may be a dielectric.

In one embodiment, sidewalls of the barrier structure may be coated with MgO films.

According to one embodiment of the present invention, a barrier structure formed of a dielectric has cavities, so that permittivity is reduced. This reduces capacitance, and thus ineffective power consumption can be reduced. In addition, since discharge occurs in the entire space of each discharge cell, the size of an area where discharge occurs greatly increases. Thus, low-voltage driving is possible, and luminance and light emission efficiency can improve.

Furthermore, heat dissipation can be greatly improved due to a convective operation through the air existing within the cavities.

BRIEF DESCRIPTION OF THE DRAWINGS

Embodiments of the present invention will become more apparent by describing in detail exemplary embodiments thereof with reference to the attached drawings.

DETAILED DESCRIPTION OF CERTAIN INVENTIVE EMBODIMENTS

Embodiments of the present invention will now be described more fully with reference to the accompanying drawings.

Figure 1:
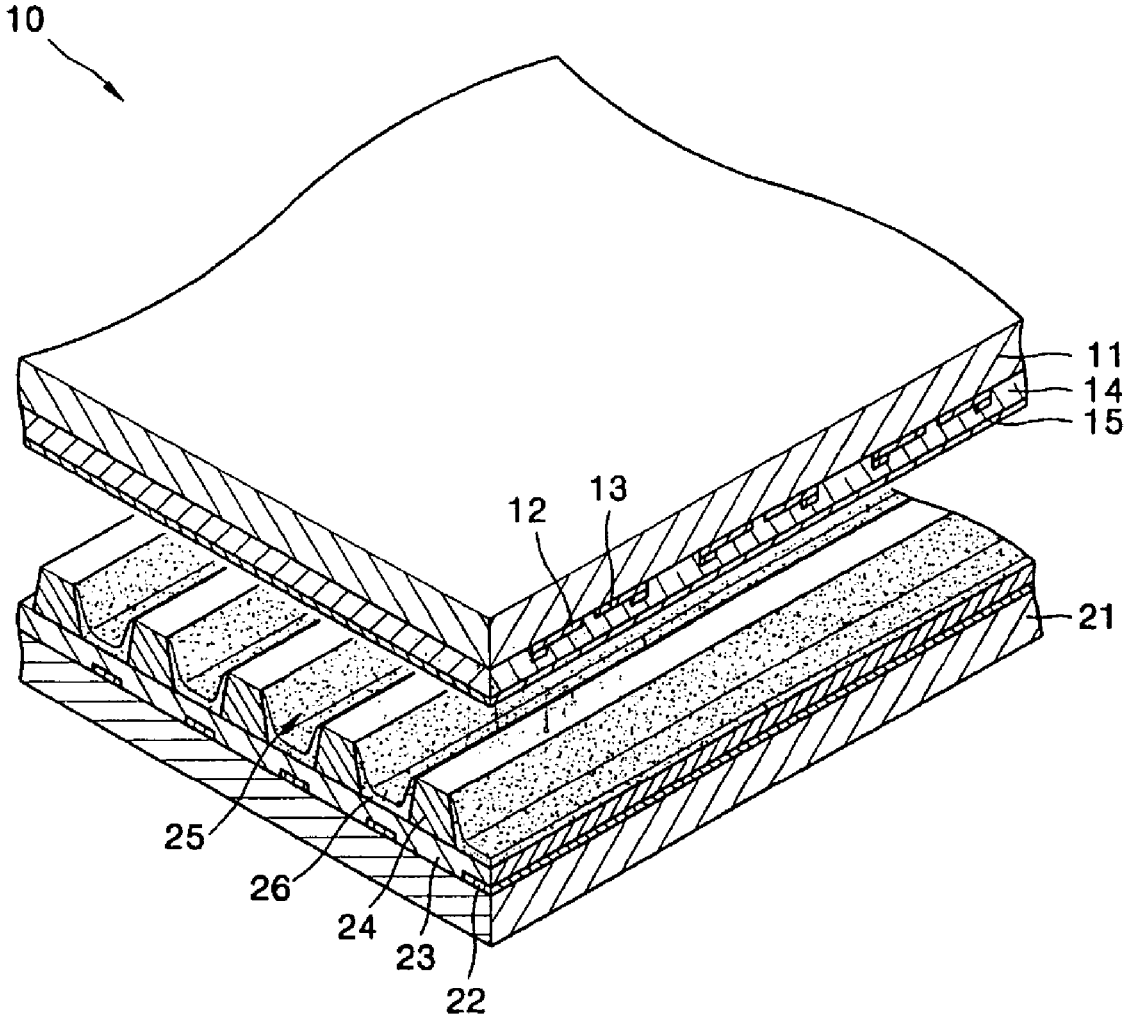
FIG. 1 (PRIOR ART)
FIG. 1 is an exploded perspective view of a part of a conventional plasma display panel (PDP).
Figure 2:
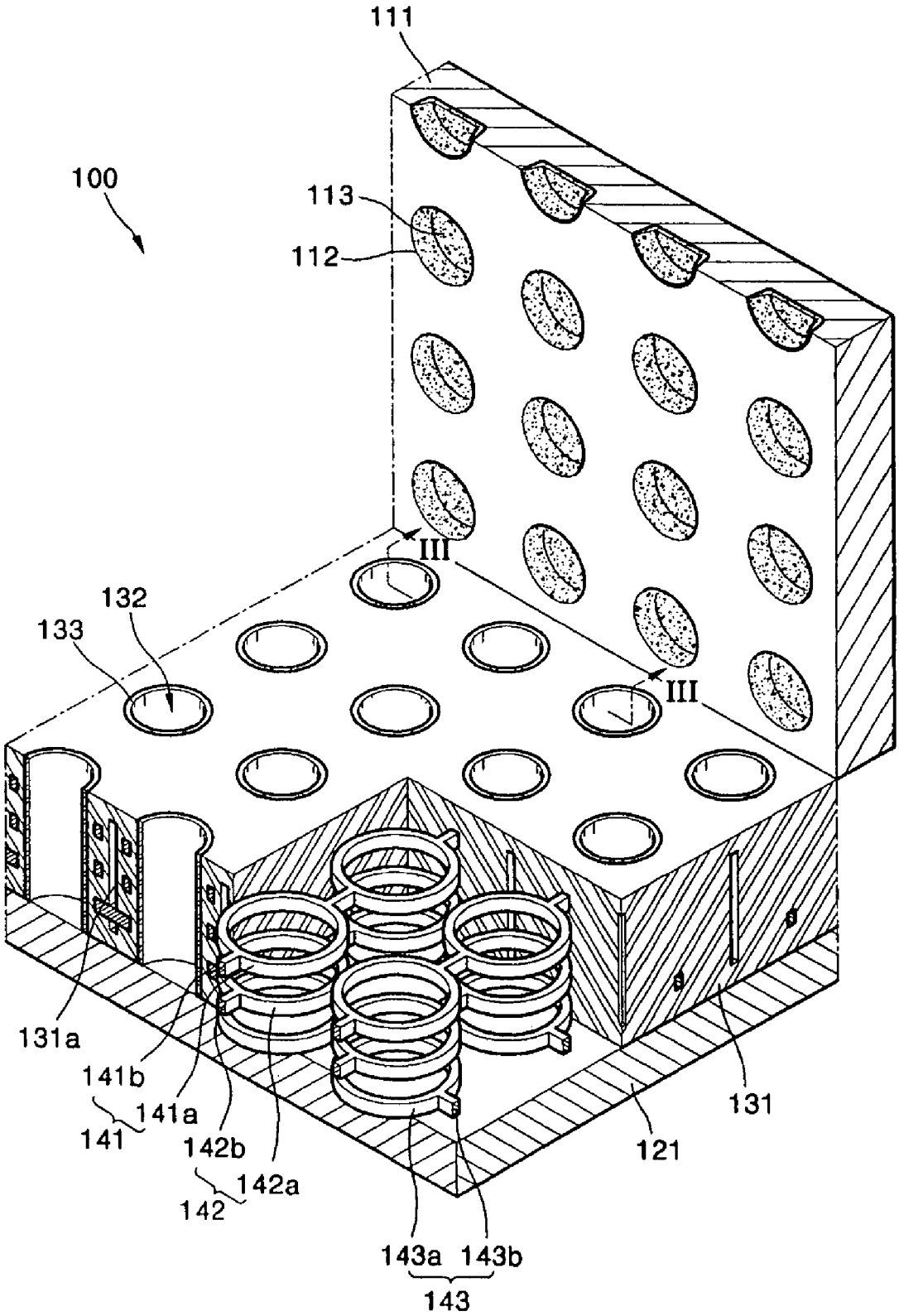
FIG. 2 is an exploded perspective view of a part of a PDP according to an embodiment of the present invention.
Figure 3:
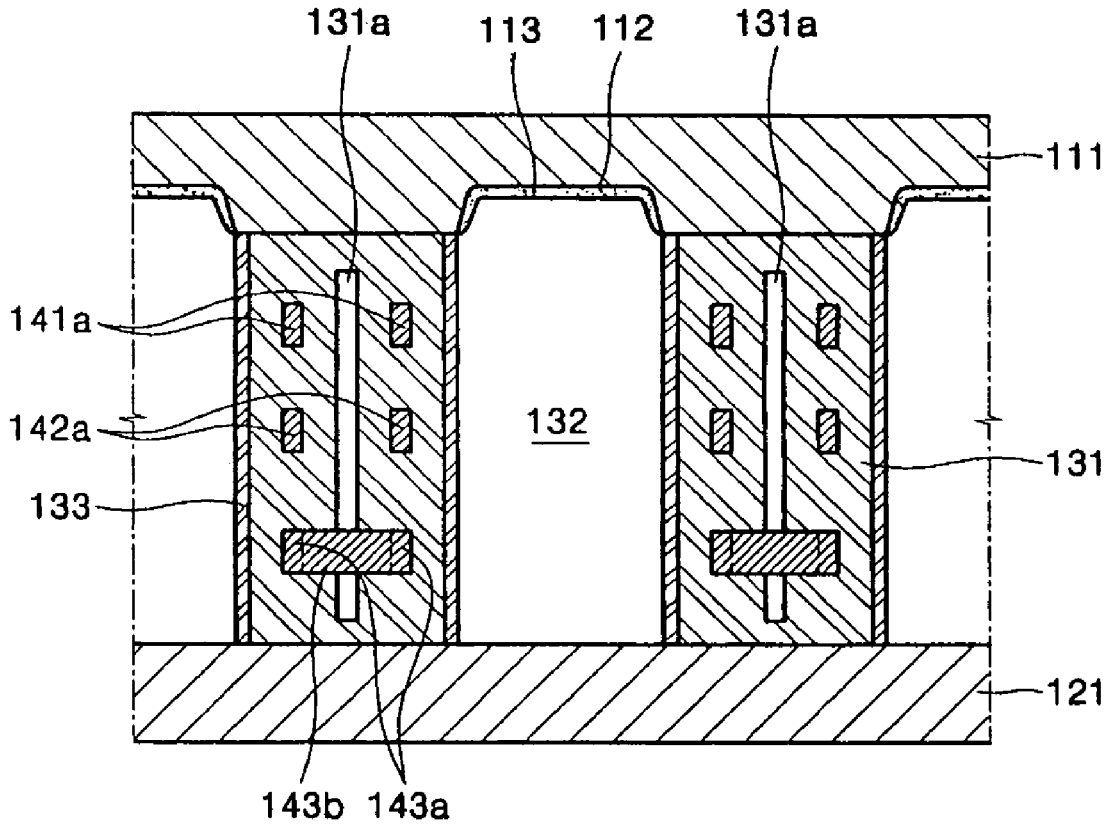
FIG. 3 is a cross-section taken along line III-III of FIG. 2.

Referring to FIGS. 2 and 3, a plasma display panel (PDP) 100 according to an embodiment of the present invention includes an upper substrate 111 and a lower substrate 121 opposing the upper substrate 111. An image is displayed on at least one of the upper and lower substrates 111 and 121. A substrate on which an image is displayed is formed of a material that can transmit light.

A barrier structure 131 is disposed between the upper and lower substrates 111 and 121. The barrier structure 131 partitions a plurality of discharge cells 132 corresponding to sub-pixels and prevents occurrence of undesired discharge due to cross talk or the like between discharge cells 132. In one embodiment, the barrier structure 131 may be designed so that the discharge cells 132 have closed structures. In one embodiment, as shown in FIG. 2, the horizontal cross-sections of the discharge cells 132 may be circular. In another embodiment, the horizontal cross-sections of the discharge cells 132 may be various shapes, such as, an oval, a rectangle, and a triangle.

In one embodiment, the barrier structure 131 is formed of a dielectric. In this case, an electric current can be prevented from flowing directly among upper discharge electrodes 141, lower discharge electrodes 142, and address electrodes 143, which are disposed within the barrier structure 131. In addition, the three electrodes 141-143 are prevented from being damaged due to a collision with charged particles generated during discharge. Furthermore, accumulating wall charges becomes easy due to induction of the charged particles. In one embodiment, the barrier structure 131 may be formed of PbO, $B_2O_3$, or $SiO_2$.

In one embodiment, an MgO film 133 having a predetermined thickness may be further formed as a protective film on inner sidewalls of the barrier structure 131. In this embodiment, direct collision of the charged particles with the barrier structure 131 can be prevented by the MgO film 133. Consequently, damage to the barrier structure 131 due to ion sputtering of the charged particles can be prevented. In addition, since the charged particles directly collide the MgO film 133, secondary electrons that contribute to discharge are emitted from the MgO film 133. Thus, low-voltage driving is realized, and luminous efficiency increases.

Phosphor layers 113, which are excited by ultraviolet radiation generated during discharge and emit visible light, are arranged in the discharge cells 132. In one embodiment, as shown in FIG. 2, grooves 112 are formed on the bottom surface of the upper substrate 111 to face the discharge cells 132 in a one-to-one correspondence. Phosphor layers 113 may be formed on the inner surfaces of the grooves 112 to have a predetermined thickness.

In one embodiment, in cases where the phosphor layers 113 are disposed on the upper substrate 111, the phosphor layers 113 may be formed of transmissive phosphor so that the visible light passes through the upper substrate 111 to display an image. In another embodiment, in order for the visible light to be transmitted by the lower substrate 121 to display an image, the phosphor layers 113 are preferably formed of reflective phosphor. In another embodiment, the grooves 112 may be formed on the top surface of the lower substrate 121 to face the discharge cells 132 in a one-to-one correspondence, and the inner surfaces of the grooves 112 may be coated with the phosphor layers 113.

As the phosphor layers 113 are accommodated within the grooves 112 formed in the upper substrate 111, the phosphor layers 113 can be sufficiently spaced from main areas where discharge occurs. Accordingly, the phosphor layers 113 can be prevented from being ion-sputtered by the charged particles, resulting in an increase in the lifespan of the PDP 100. In addition, although an image is displayed for a long period of time, the frequency of occurrence of image sticking or permanent image can be remarkably reduced.

Each of the phosphor layers 113 is generally formed of one of red, green, and blue phosphors that emit red, green, and blue visible light, respectively, to accomplish color display. Consequently, the phosphor layers 113 include red, green, and blue phosphor layers. Sub pixels are divided into red sub-pixels, green sub-pixels, and blue sub-pixels according to which of the red, green, and blue phosphor layers is disposed over a discharge cells. The red, green, and blue sub-pixels are included in a unit pixel, and thus a single unit pixel displays various colors depending on a combination of the three colors.

The discharge cells 132 covered with the phosphor layers 113 are filled with discharge gas. In one embodiment, the discharge gas may be a mixture of gas that generates ultraviolet light, such as, Xe, and gas that serves as a buffer, such as, Ne.

Upper discharge electrodes 141 and lower discharge electrodes 142 extend in the same direction and parallel to each other within the barrier structure 131 that partitions the discharge cells 132. In one embodiment, the discharge electrodes 141 and 142 are disposed one over another to surround the discharge cells 132 together. The upper discharge electrodes 141 are closer to the upper substrate 111 than the lower discharge electrodes 142.

One of the discharge electrodes 141 and 142 serves as common electrodes, and the other serves as scan electrodes. In one embodiment, in cases where address electrodes 143 are located under the lower discharge electrodes 142 as shown in FIG. 2, the lower discharge electrodes 142 serve as scan electrodes. In this embodiment, address voltages applied between the lower discharge electrodes 142 and the address electrodes 143 are reduced, resulting in smooth address discharge occurring therebetween. In one embodiment, at least one of the discharge electrodes 141, 142, and the address electrodes 143 may be formed of a conductive metal, such as, aluminum, copper, or silver.

The upper discharge electrodes 141 are spaced from one another at predetermined intervals and each extend in one direction. In one embodiment, the upper discharge electrodes 141 may be designed so as to fully surround the discharge cells 132, which are arranged in the extending direction of the upper discharge electrodes 141. In one embodiment, each of the upper discharge electrodes 141 may have an array of body portions 141*a*, each having a ring shape to surround each of the discharge cells 132, and an array of upper connection portions 141*b* that connect the body portions 141*a* to each other. In one embodiment, the body portions 141*a* have shapes corresponding to the shapes of the discharge cells 132 such that each of the body portions 141*a* is spaced from its corresponding discharge cell 132 by a constant distance.

The lower discharge electrodes 142 extend in the same direction as the extending direction of the upper discharge electrodes 141 and are spaced from each other at predetermined intervals. In one embodiment, like the upper discharge electrodes 141, the lower discharge electrodes 142 may be designed so as to fully surround the discharge cells 132, which are arranged in the extending direction of the lower discharge electrodes 142. In one embodiment, each of the lower discharge electrodes 142 may have an array of body portions 142*a*, each having a ring shape to surround each of the discharge cells 132, and an array of lower connection portions 142*b* that connect the body portions 142*a* to each other. Each of the upper and lower discharge electrodes may have various other shapes and is not limited to the ring shape.

The address electrodes 143 within the barrier structure 131 produce address discharge together with scan electrodes (i.e., either the upper discharge electrodes 141 or the lower discharge electrodes 142) so that a discharge cell 132 is selected. To achieve this, the address electrodes 143 are spaced from each other and each extend in a direction perpendicular to the extending direction of the upper and lower discharge electrodes 141 and 142. In one embodiment, as illustrated in FIG. 2, the address discharge electrodes 143 may be designed so as to fully surround the discharge cells 132, which are arranged in the extending direction of the address discharge electrodes 143. In one embodiment, each of the address discharge electrodes 143 may have an array of address discharge portions 143*a*, each having a ring shape to surround each of the discharge cells 132, and an array of address connection portions 143*b* that connect the address discharge portions 143*a* to each other.

In one embodiment, in contrast to FIG. 2, the address electrodes 143 may be located over the upper discharge electrodes 141 or located between the upper discharge electrodes 141 and the lower discharge electrodes 142. The address electrodes 143 may have various shapes other than the shape shown in FIG. 2. In one embodiment, the address electrodes 143 may be omitted. In this embodiment, the upper discharge electrodes 141 each run in a direction perpendicular to the extending direction of the lower discharge electrodes 142 so that a discharge cell can be selected. In this embodiment, one of the upper discharge electrodes 141 and the lower discharge electrodes 142 serve as address and sustain electrodes, and the other serve as scan and sustain electrodes.

In one embodiment, the body portions 141*a* of the upper discharge electrodes 141, the body portions 142*a* of the lower discharge electrodes 142, and the address discharge portions 143*a* are shaped to surround the discharge cells 132 as shown in FIG. 2. In another embodiment, the portions 141*a*-143*a* may be shaped to surround only parts of the discharge cells 132. For example, each of the body portions 141*a*, 142*a* and the address discharge portions 143*a* may have a C shape.

Figure 4:
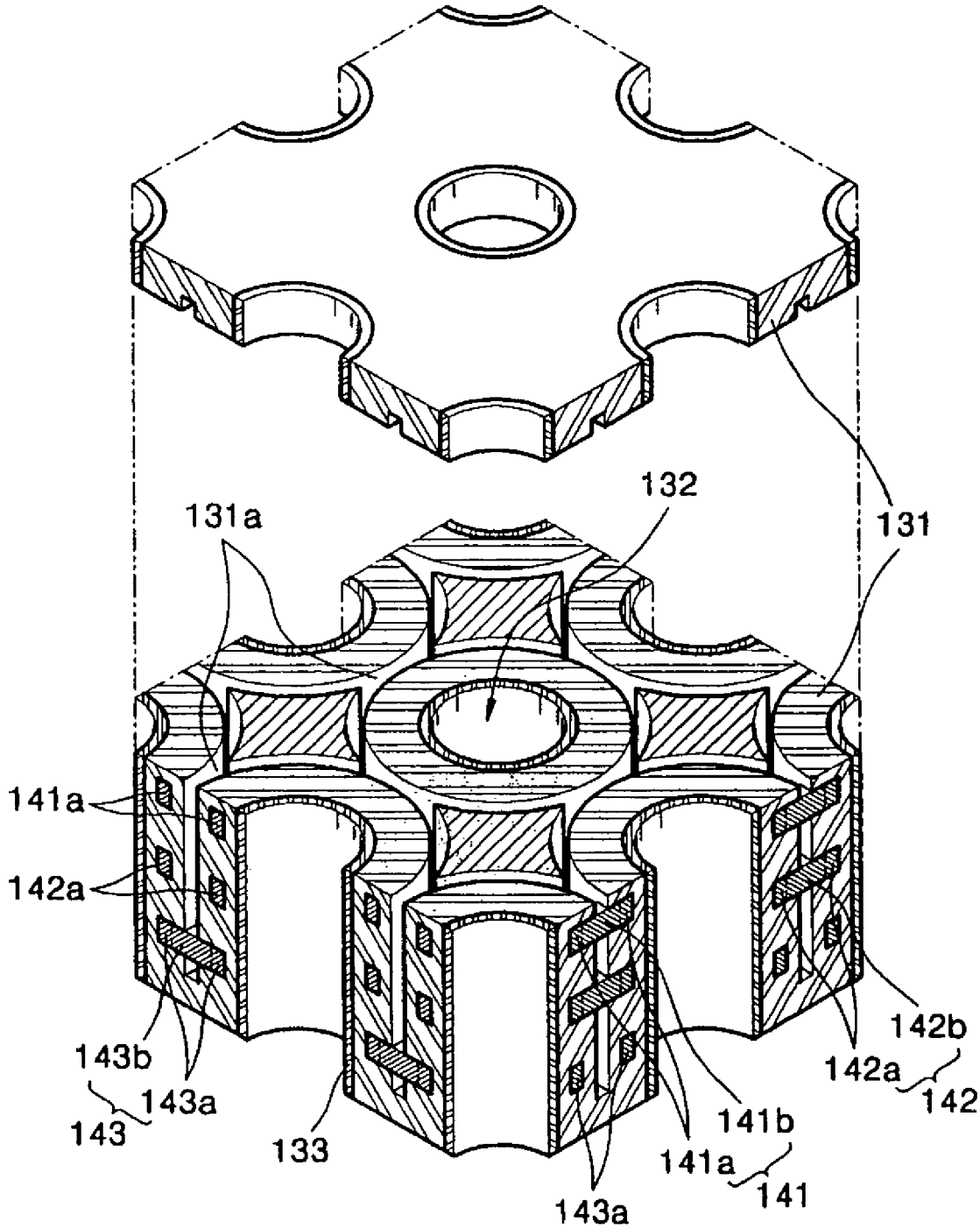
FIG. 4 is an exploded perspective view of a barrier structure shown in FIG. 2.

In one embodiment, cavities 131*a* as illustrated in FIGS. 3 and 4 are formed in the barrier structure 131 in which the upper discharge electrodes 141, the lower discharge electrodes 142, and the address electrodes 143 are disposed. The cavities 131*a* contribute to reducing ineffective consumption of power as discussed below. In one embodiment as shown in FIG. 3, the cavities 131*a* are disposed between the body portions 141*a*. The cavities 131*a* may contain air or may be in vacuum state. Although the cavities can be formed in other locations such as between the body portions 142*a* or between upper and body portions 141*a*, 142*a*, the explanation will be provided based on the cavities formed between the body portions 141*a* for convenience. As discussed above, the barrier structure 131 is formed of a dielectric material. Due to the cavities formed between the body portions 141*a*, the amount of dielectric material of a space ("first space" hereinafter), including the cavities, formed between the upper discharge electrodes 141*a*, is less than that of a corresponding space ("second space" hereinafter) in the conventional barrier structure without cavities. Thus, the permittivity of the first space including a cavity is less than that of the second space which is composed of solely dielectric material. Capacitance is generally proportional to permittivity provided that the area and distance between the body portions 141*a* are constant. Considering the known relationship that power consumption is generally proportional to capacitance provided that applied voltage and frequency are constant, reduced capacitance provides reduced power consumption. Hence, the barrier structure containing cavities can decrease ineffective power consumption.

Furthermore, the cavities 131*a* rapidly emit a great amount of heat generated in the discharge cells 132 during gas discharge to the outside due to a convective action through the air existing in the cavities 131*a*.

In another embodiment, the cavities 131*a* may be disposed between body portions 142*a* and between address discharge portions 143*a*. In another embodiment, as illustrated in FIGS. 3 and 4, each of the cavities 131*a* may extend in a vertical direction from areas corresponding to the body portions 141*a* to areas corresponding to the address discharge portions 143*a*. In another embodiment, as illustrated in FIG. 4, the cavities 131*a* may be formed around the discharge cells 132 to surround the discharge cells 132 so as to be connected to one another. In this embodiment, the cavities 131*a* are each formed in a shape corresponding to the shape of the discharge cells 132. Although the cavities 131*a* are connected to one another in FIG. 4, the present invention is not limited to this connection.

The sustain discharge occurs near inner sidewalls of the barrier structure 131 that defines the discharge cells 132 and spreads to the centers of the discharge cells 132. Hence, the area where discharge occurs increases compared to the conventional art, and the area where sustain discharge occurs increases, so that spatial charges not used in the conventional art contribute to light emission. Accordingly, the amount of plasma produced during discharge can increase, so that low-voltage driving is possible. Due to the sustain discharge caused by such a mechanism, ultraviolet light is emitted from discharge gas and excites the phosphor layers 113 formed in the discharge cells 132 to emit visible light.

Figure 5:
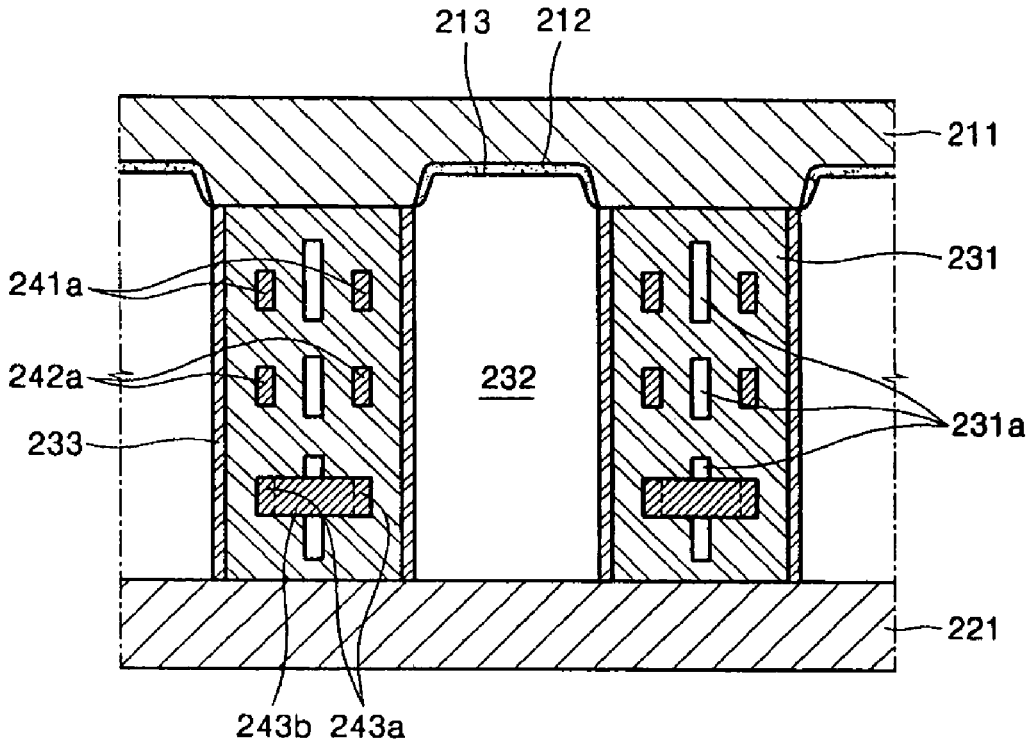
FIG. 5 is a cross-section of a modification of a cavity shown in FIG. 3.

In another embodiment, as illustrated in FIG. 5, cavities 231*a* are included in a barrier structure 231 and may be formed between body portions 241*a*, between body portions 242*a*, and between address discharge portions 243*a* so as to be separately disposed for the portions 241*a*-243*a*. An upper substrate 211, a lower substrate 221, phosphor layers 213, discharge cells 232, MgO films 233, body portions 241*a*, body portions 242*a*, address discharge portions 243*a*, and address connecting portions 243*b* are the same as those of the FIG. 3 embodiment, respectively, so they will not be described herein.

Figure 6:
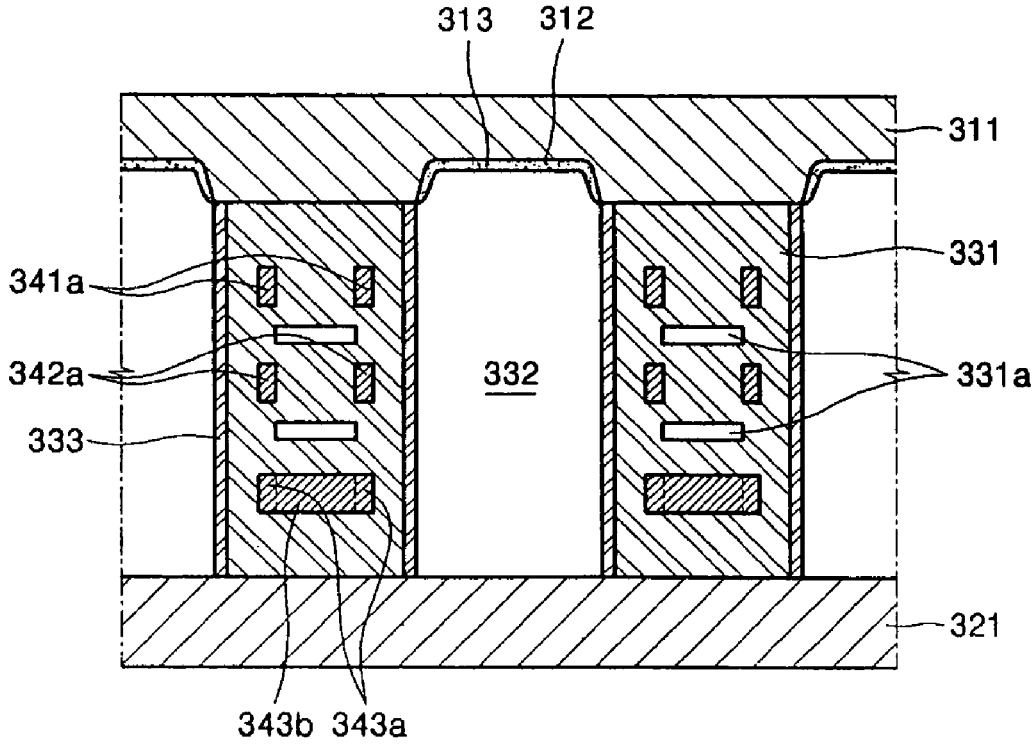
FIG. 6 is a cross-section of another modification of the cavity shown in FIG. 3.

In another embodiment, as illustrated in FIG. 6, cavities 331*a* are included in a barrier structure 331 and may be horizontally formed between body portions 341*a* and body portions 342*a* and between the body portions 342*a* and address discharge portions 343*a*. The cavities 331*a* reduce permittivity between the body portions 341*a* and the body portions 342*a* to decrease capacitance. Similarly, the cavities 331*a* reduce permittivity between the body portions 342*a* and the address discharge portions 343*a* to decrease capacitance. Hence, ineffective power consumption can decrease. Similar to the cavities 131*a* illustrated in FIG. 4, the cavities 331*a* rapidly emit a great amount of heat generated in the discharge cells 132 during gas discharge to the outside due to a convective action through the air existing in the cavities. Similar to the cavities 131*a*, the cavities 331*a* may be formed around the discharge cells 332 to surround the discharge cells 332 so as to be connected to one other. The cavities 331*a* may be each formed in a shape corresponding to the shape of the discharge cells 332.

Figure 7:
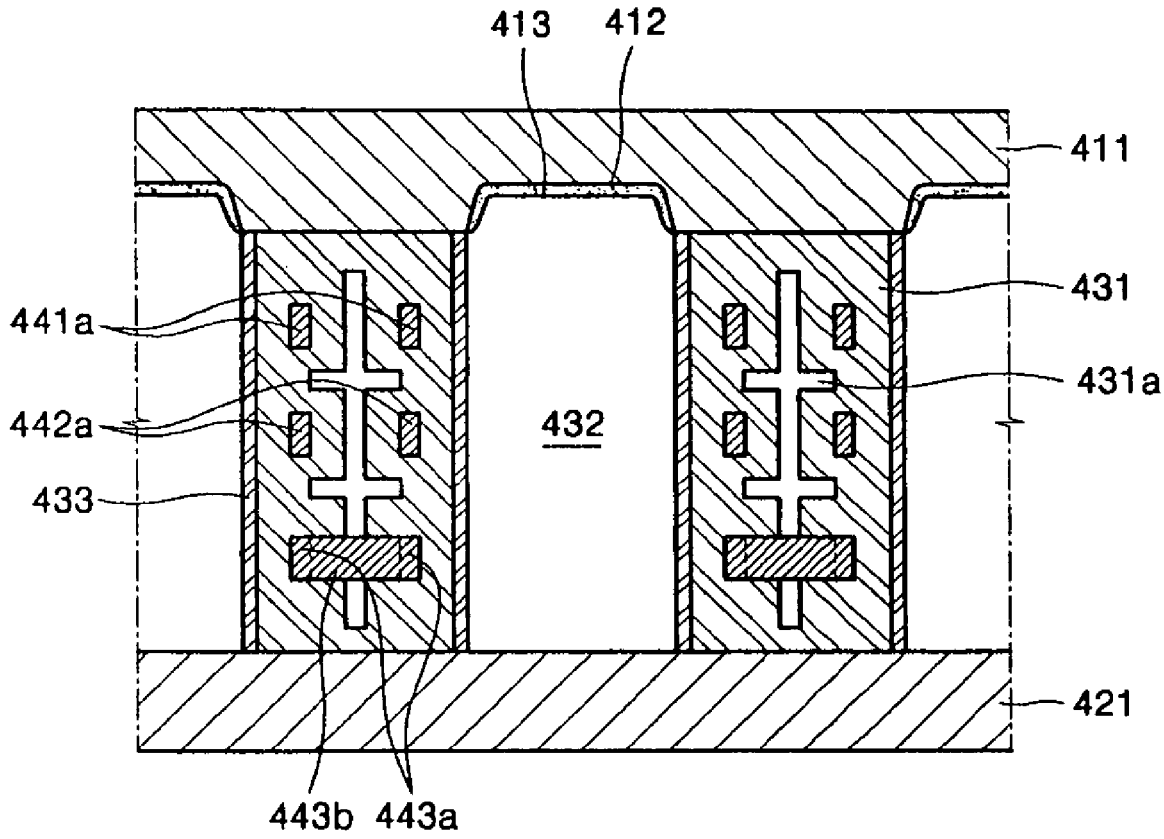
FIG. 7 is a cross-section of another modification of the cavity shown in FIG. 3.

In another embodiment, as illustrated in FIG. 7, cavities 431*a* obtained by combining the cavities 131*a* of FIG. 3 with the cavities 331*a* of FIG. 6 are formed in a barrier structure 431. In this embodiment, each of the cavities 431*a* may extend from an area between body portions 441*a* to an area between address discharge portions 443*a*, extend from an area between body portions 441*a* and 442*a* to an area between an adjacent body portion 441*a* and an adjacent body portion 442*a*. Furthermore, each of the cavities 431*a* may extend from an area between a body portion 442*a* and an address discharge portion 443*a* to an area between an adjacent body portion 442*a* and an adjacent address discharge portion 443*a*.

The remaining elements are the same as those of the FIG. 3 embodiment, respectively, so they will not be described herein.

Figure 8:
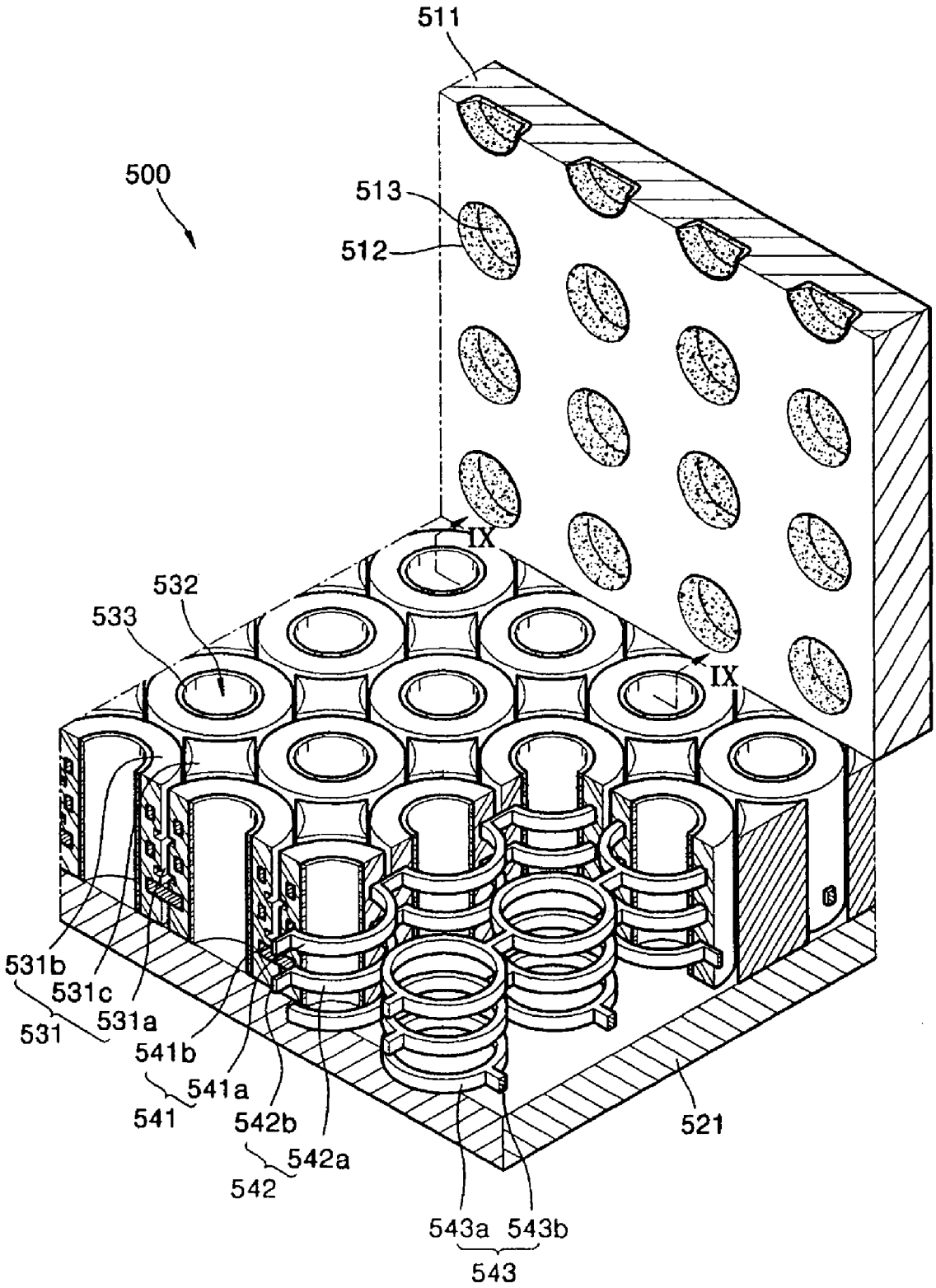
FIG. 8 is an exploded perspective view of a part of a PDP according to another embodiment of the present invention.
Figure 9:
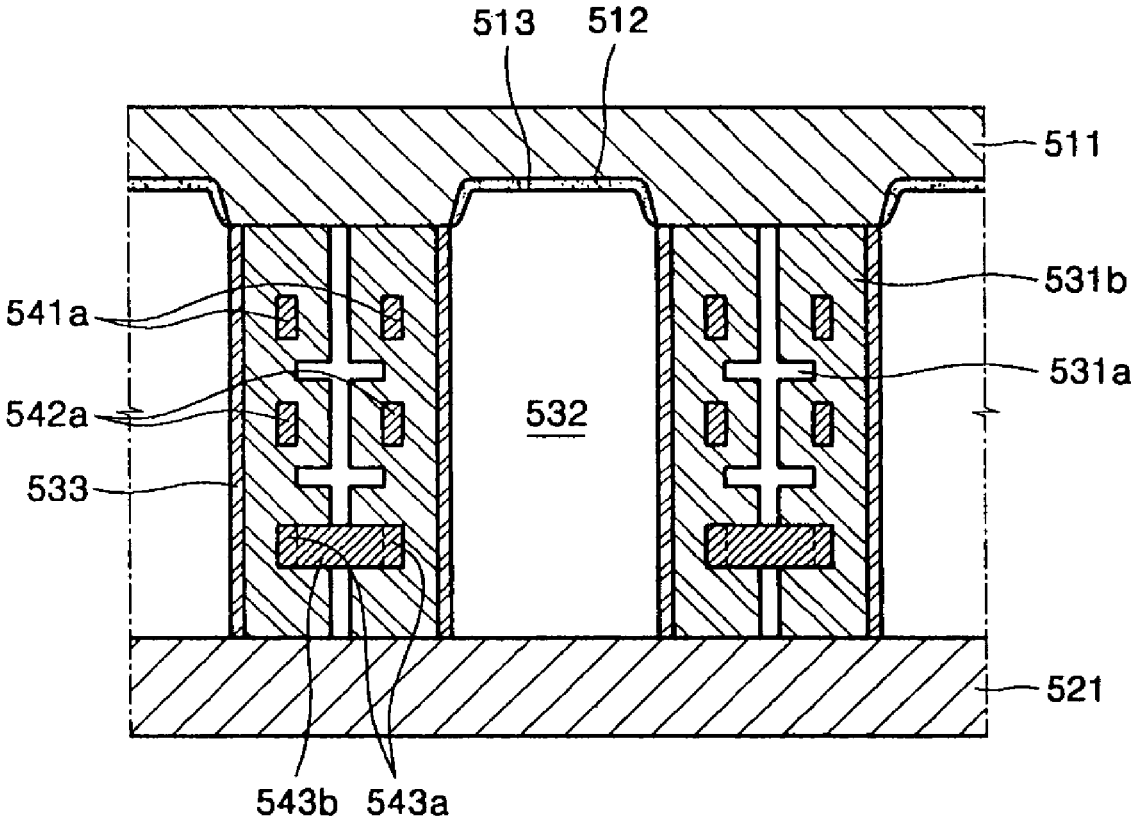
FIG. 9 is a cross-section taken along line IX-IX of FIG. 8.

FIG. 8 is an exploded perspective view of a part of a PDP 500 according to another embodiment of the present invention. FIG. 9 is a cross-section taken along line IX-IX of FIG. 8.

Referring to FIGS. 8 and 9, the PDP 500 includes an upper substrate 511 and a lower substrate 521.

A barrier structure 531 which partitions discharge cells 532 and in which cavities 531*a* are formed is disposed between the upper substrate 511 and the lower substrates 521.

Upper discharge electrodes 541, lower discharge electrodes 542, and address electrodes 543 are disposed within the barrier structure 531. Inner sidewalls of the barrier structure 531 may be coated with MgO films 533 with a predetermined thickness to serve as protective layers.

In one embodiment, the upper discharge electrodes 541 include body portions 541*a* and upper connection portions 541*b*.

In one embodiment, the lower discharge electrodes 542 include body portions 542*a* and lower connection portions 542*b*.

The PDP 500 of FIG. 8 is different from the PDP 100 of FIG. 2 in that the cavities 531*a* vertically extend across the barrier structure 531, namely, from one end of the barrier structure 531 to the other end thereof, instead of extending by a part of the barrier structure 531, so as to surround the discharge cells 532 and are connected to one another. In one embodiment, the barrier structure 531 includes the cavities 531*a*, first barrier ribs 531*b*, and second barrier ribs 531*c*.

In one embodiment, the first barrier ribs 531*b* surround the discharge cells 532 and each has a shape of a tube whose cross-section is a circular ring. In one embodiment, the second barrier ribs 531*c* are in the shape of islands. In this embodiment, the volume of the cavities 531*a* increases compared with that of the PDP 100 to further reduce permittivity between body portions 541*a*, between body portions 542*a*, and between address discharge portions 543*a* than the PDP 100. Accordingly, the capacitance decreases, resulting in a further reduction of ineffective power consumption than the PDP 100.

In addition, when the PDP 500 operates, a large amount of heat generated in the discharge cells 532 can be rapidly discharged to the outside due to a convective operation through the air existing within the cavities 531*a*.

Since the other components and operations thereof in the PDP 500 are almost the same as those in the PDP 100, a detailed description thereof will be omitted.

Figure 10:
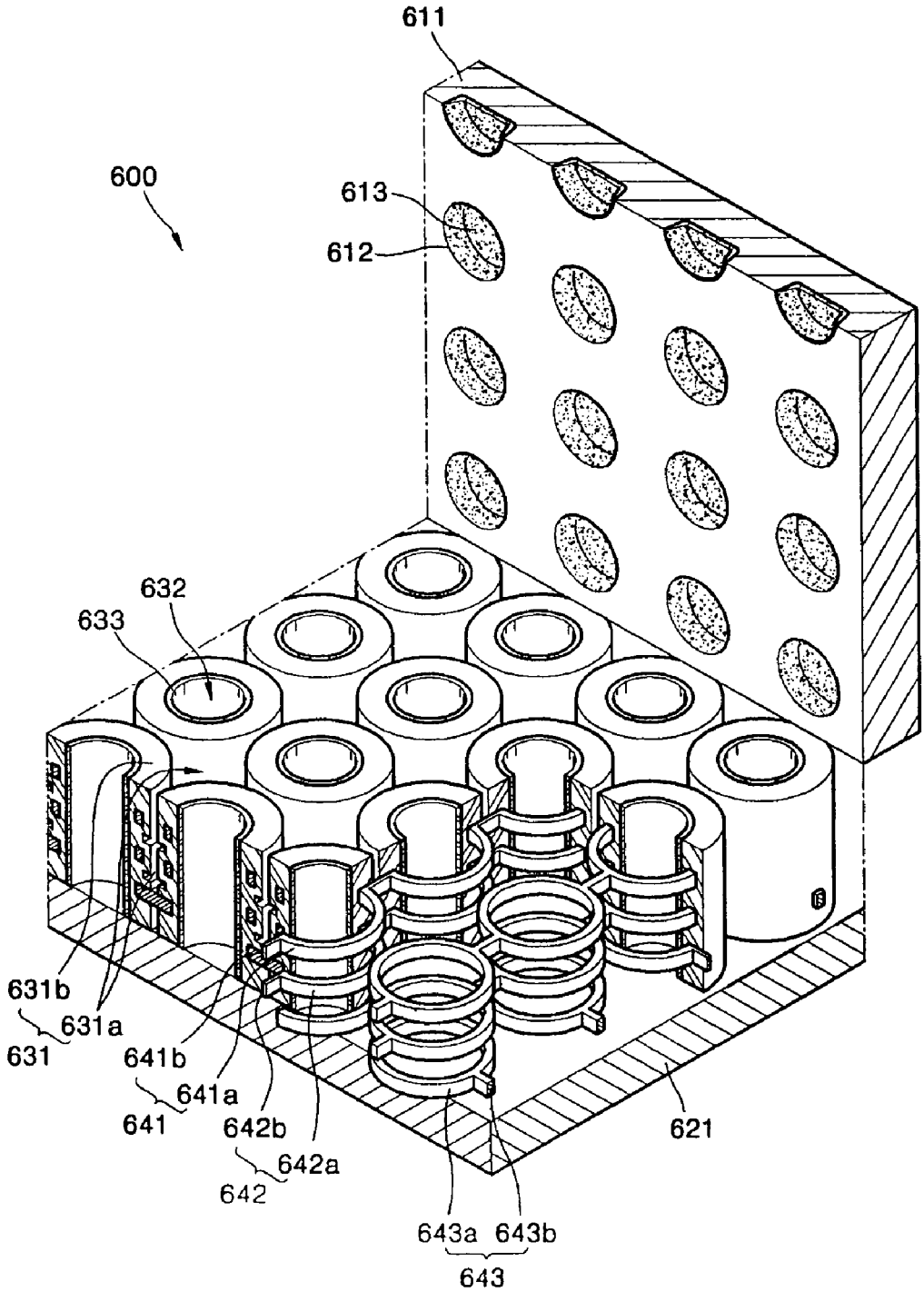
FIG. 10 is an exploded perspective view of a part of a PDP according to another embodiment of the present invention.

FIG. 10 is an exploded perspective view of a part of a PDP 600 according to another embodiment of the present invention.

Referring to FIG. 10, the PDP 600 includes an upper substrate 611 and a lower substrate 621.

A barrier structure 631 which partitions discharge cells 632 and in which cavities 631*a* are formed is disposed between the upper and lower substrates 611 and 621.

Upper discharge electrodes 641, lower discharge electrodes 642, and address electrodes 643 are disposed within the barrier structure 631. Inner sidewalls of the barrier structure 631 may be coated with MgO films 633 with a predetermined thickness to serve as protective layers.

In one embodiment, the upper discharge electrodes 641 include body portions 641*a* and upper connection portions 641*b*.

In one embodiment, the lower discharge electrodes 642 include body portions 642*a* and lower connection portions 642*b*.

The PDP 600 is different from the PDP 100 in that the cavities 631*a* vertically extend across the barrier structure 631, namely, from one end of the barrier structure 631 to the other end thereof, instead of extending by a part of the barrier structure 631, so as to surround the discharge cells 632 and are connected to one another. In one embodiment, the barrier structure 631 includes the cavities 631*a* and barrier ribs 631*b*. The barrier ribs 631*b* surround the discharge cells 632 and each have a shape of a tube whose cross-section is a circular ring. However, the prevent invention is not limited to the circular-ring cross-section. That is, the cross-section of each of the barrier ribs 631*b* may be any ring as long as it can surround each of the discharge cells 632, for example, a rectangular ring, a polygonal ring, or an oval ring.

In FIGS. 6-10, 343*b*, 443*b*, 543*b* and 643*b* represent address connection portions. In FIGS. 7-10, 412, 512, 612 refer to grooves while 413, 513, 613 refer to phosphor layers.

In contrast with the barrier structure 531, the barrier structure 631 does not include island-type barrier ribs like the second barrier ribs 531*c*. Hence, the volume of the cavities 631*a* is larger than that of the cavities 531*a*.

In this embodiment, the size of the cavities 631*a* drastically increases compared with those of the PDPs 100 and 500 to further reduce permittivity between body portions 641*a*, between body portions 642*a*, and between address discharge portions 643*a* than the PDPs 100 and 500. Accordingly, the capacitance decreases, resulting in a further reduction of ineffective power consumption than the PDPs 100 and 500.

In addition, when the PDP 600 operates, a large amount of heat generated in the discharge cells 632 can be rapidly discharged to the outside due to a convective operation through the air existing within the cavities 631*a*.

Since the other components and operations thereof in the PDP 600 are almost the same as those in the PDP 100, a detailed description thereof will be omitted.

As described above, PDPs according to embodiments of the present invention can reduce ineffective power consumption and greatly improve heat discharge.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A plasma display panel, comprising:

an upper substrate;

a lower substrate facing the upper substrate;

a barrier structure formed between the upper substrate and the lower substrate and defining discharge cells, wherein a plurality of cavities are defined within the barrier structure and are formed between and separate from discharge spaces of the discharge cells; wherein the cavities are at least partially not filled by electrodes;

a plurality of upper discharge electrodes formed within the barrier structure and each upper discharge electrode surrounding at least a portion of each of the discharge cells;

a plurality of lower discharge electrodes formed within the barrier structure, located under the upper discharge electrodes, and each lower discharge electrode surrounding at least a portion of each of the discharge cells; and phosphor layers formed in the discharge cells.

2. The plasma display panel of claim 1, wherein each of the discharge cells has a closed structure.

3. The plasma display panel of claim 2, wherein:

each of the upper discharge electrodes comprises a body portion that surrounds at least a portion of each discharge cell and a connection portion connecting the body portions of adjacent upper discharge electrodes; and each of the lower discharge electrodes comprises a body portion that surrounds at least a portion of each discharge cell and a connection portion connecting the body portions of adjacent lower discharge electrodes.

4. The plasma display panel of claim 3, wherein each of the plurality of cavities is vertically formed between the body portions of adjacent upper discharge electrodes and between the body portions of adjacent lower discharge electrodes.

5. The plasma display panel of claim 4, wherein at least one cavity is further horizontally expanded from one vertically formed cavity and located between an upper discharge electrode and a lower discharge electrode adjacent to the upper discharge electrode.

6. The plasma display panel of claim 4, wherein at least one cavity is vertically continuously formed.

7. The plasma display panel of claim 4, wherein at least one cavity is vertically discontinuously formed.

8. The plasma display panel of claim 3, wherein at least one cavity is horizontally formed between an upper discharge electrode and a lower discharge electrode adjacent to the upper discharge electrode.

9. The plasma display panel of claim 4, wherein each of the plurality of cavities is formed so as to surround a respective discharge cell.

10. The plasma display panel of claim 3, further comprising a plurality of address electrodes spaced from each other in the barrier structure, wherein each address electrode surrounds at least a portion of each discharge cell and is formed so as to generally cross each of the upper and lower discharge electrodes.

11. The plasma display panel of claim 10, wherein each of the address electrodes comprises a body portion which surrounds the discharge cells and a connection portion connecting the body portions of adjacent address discharge electrodes.

12. The plasma display panel of claim 11, wherein each of the plurality of cavities is vertically formed and disposed i) between the body portions of adjacent upper discharge electrodes, ii) between the body portions of adjacent lower discharge electrodes, and iii) between the body portions of adjacent address discharge electrodes.

13. The plasma display panel of claim 12, wherein at least one cavity is further horizontally expanded from one vertically formed cavity and disposed between an upper discharge electrode and an adjacent lower discharge electrode and between the adjacent lower discharge electrode and an address discharge electrode adjacent to the lower discharge electrode.

14. The plasma display panel of claim 12, wherein at least one cavity is vertically continuously formed.

15. The plasma display panel of claim 12, wherein at least one cavity is vertically discontinuously formed.

16. The plasma display panel of claim 11, wherein at least one cavity is horizontally formed and disposed between an upper discharge electrode and an adjacent lower discharge electrode and between the adjacent lower discharge electrode and an address discharge electrode adjacent to the lower discharge electrode.

17. The plasma display panel of claim 12, wherein each of the plurality of cavities is formed so as to surround a respective discharge cell.

18. The plasma display panel of claim 11, wherein i) the upper discharge electrodes, ii) the lower discharge electrodes, and iii) the address electrodes are formed of a conductive metal.

19. The plasma display panel of claim 2, wherein grooves are formed on a surface of the upper substrate close to the barrier structure so as to face the discharge cells, and the grooves are coated with phosphor layers.

20. The plasma display panel of claim 19, wherein when an image is displayed on the upper substrate by visible light transmitted through the upper substrate, the phosphor layers formed on the grooves are formed of transmissive phosphor.

21. The plasma display panel of claim 19, wherein when an image is displayed on the lower substrate by visible light transmitted through the lower substrate, the phosphor layers formed on the grooves are formed of reflective phosphor.

22. The plasma display panel of claim 1, wherein the upper discharge electrodes are formed so as to generally cross the lower discharge electrodes.

23. The plasma display panel of claim 1, wherein the barrier structure is formed of a dielectric material.

24. The plasma display panel of claim 1, wherein sidewalls of the barrier structure are coated with MgO films.

25. A plasma display panel, comprising:

a barrier structure formed between two opposing substrates and defining discharge cells, wherein a plurality of cavities are defined within the barrier structure and are formed between and separate from discharge spaces of the discharge cells; wherein the cavities are at least partially not filled by electrodes;

a plurality of first discharge electrodes formed within the barrier structure, wherein the plurality of first discharge electrodes are closer to the first substrate than the second substrate; and a plurality of second discharge electrodes formed within the barrier structure, wherein the plurality of second discharge electrodes are closer to the second substrate than the first substrate.

26. The plasma display panel of claim 25, wherein each of the plurality of cavities is defined in one of the following location: i) between two adjacent first discharge electrodes, ii) between two adjacent second discharge electrodes and iii) between one of the plurality of first electrodes and one of the plurality of second electrodes adjacent to the one first electrode.

27. The plasma display panel of claim 25, wherein each of the plurality of cavities is formed so as to surround a respective discharge cell.

* * * * *